United States Patent [19]

Miyamoto

[11] 4,084,141

[45] Apr. 11, 1978

[54] ZIG-ZAG SLOTTED COAXIAL CABLE FOR RADIO FREQUENCY SIGNAL COUPLING

[75] Inventor: Yoshio Miyamoto, Yokohama, Japan

[73] Assignee: Sumitomo Electric Industries, Ltd., Osaka, Japan

[21] Appl. No.: 736,602

[22] Filed: Oct. 28, 1976

[30] Foreign Application Priority Data

Nov. 1, 1975 Japan ..... 50-131744

[51] Int. Cl.[2] ..... H01P 3/06

[52] U.S. Cl. ..... 333/84 L; 333/97 R

[58] Field of Search ..... 333/84 L, 97 R; 343/771

[56] References Cited

U.S. PATENT DOCUMENTS 3,810,186 5/1974 Nakahara et al. ..... 343/771

FOREIGN PATENT DOCUMENTS 1,235,888 6/1971 United Kingdom ..... 333/84 L

*Primary Examiner*—Paul L. Gensler

*Attorney, Agent, or Firm*—Sughrue, Rothwell, Mion, Zinn and Macpeak

[57] ABSTRACT

A coaxial cable for radio frequency signal coupling comprises elongated, coaxial, central and external conductors. A continuous slot is provided in the external conductor in the form of a regularly alternately undulating or zig-zag pattern.

7 Claims, 8 Drawing Figures

ZIG-ZAG SLOTTED COAXIAL CABLE FOR RADIO FREQUENCY SIGNAL COUPLING

BACKGROUND OF THE INVENTION

The present invention relates to an improved coaxial cable for radio frequency signal coupling.

An open type coaxial cable of the prior art is shown in the side view and sectional view of FIGS. 1 (a) and (b), respectively. The cable comprises coaxially arranged inner and outer conductors 1 and 2, respectively. A continuous slot 3 is provided in the outer conductor along the length of the cable. This type of cable makes use of the outwardly protruding portion of the TEM mode electromagnetic field which propagates in the space between the inner and outer conductors for purposes of communicating with an object adjacent the cable. Such object may be a train, an automobile, an industrial crane, or the like, may be movable or stationary, and would typically mount a signal pickup device on the side of the object facing the coaxial cable slot. The communication between the coaxial cable and moving object may be to implement remote control, or simply to convey information. The degree of radio-wave coupling between the cable and such a moving object travelling therealong often cannot be made sufficiently large, because the coaxial cable shown FIG. 1 has no mechanism for positively radiating leakage waves from the slot. Further, the protruding external electromagnetic field coupling the cable and the moving object may adversely affect the signal transmission of the cable due to the influence of the outer environment surrounding the cable, e.g., pollution, water, etc. Consequently, the quality of signal transmission may become fatally deteriorated. The greater the amount of radio-wave coupling required to be taken out, the more the width of the slot must be increased. This widening accentuates the effects of outer environmental changes, whereby stabilized radio-wave coupling and transmission is increasingly degraded.

SUMMARY OF THE INVENTION

The present invention eliminates the above-mentioned disadvantages by providing an open type coaxial cable for radio frequency signal coupling provided with an elongated slot having an alternately notched, undulating, or zig-zag configuration.

DETAILED DESCRIPTION OF THE PREFERRED EMBODIMENTS

Figure 2A:
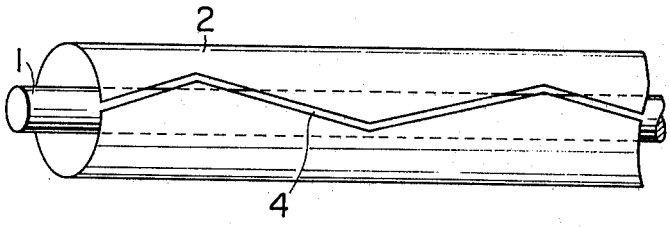
FIGS. 2(*a*) and 2(*b*) show a side view and a sectional view of a coaxial cable for radio frequency signal coupling in accordance with the present invention.
Figure 2B:
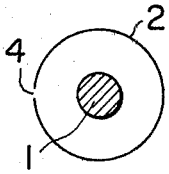

A first embodiment of a coaxial cable according to the present invention is shown in FIGS. 2(*a*) and 2(*b*), wherein inner and outer conductors are designated 1 and 2, respectively. A continuous slot 4 is provided in the outer conductor along the length of the cable in the form of an alternately undulating of zig-zag pattern.

The essence of the invention resides in this slot configuration in the outer conductor of the cable.

Figure 3:
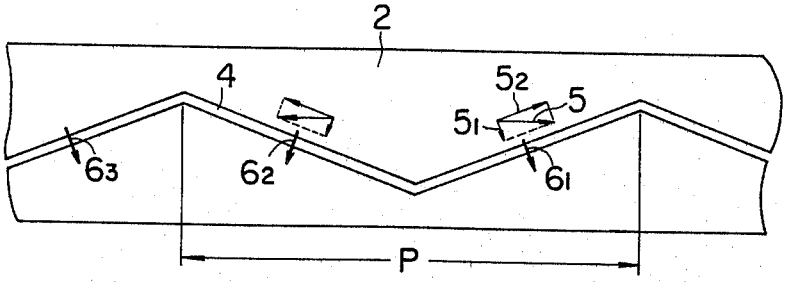
FIG. 3 shows a functional illustration of the cable shown in FIG. 2, and FIGS. 4(*a*), 4(*b*) and 4(*c*) show embodiments of the present invention wherein three different slot patterns are employed.

The function of the slot will be explained with reference to FIG. 3. The principal transmission mode in a coaxial cable is the TEM mode, i.e., electric current flows along the conductor in the longitudinal direction of the cable. Accordingly, as shown in FIG. 3, a part of the electric current flowing in the external conductor, i.e., the $5_1$ component, is cut or interrupted by the slot since the latter is slanted with respect to the cable axis. Therefore, the slot provides an electromagnetic-wave exciting function whereby preferred radio frequency signal coupling characteristics can be obtained.

Figure 1A:
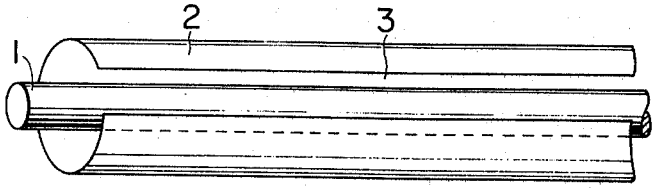
FIG. 1a PRIOR ART
FIGS. 1(*a*) and 1(*b*) show a side view and a sectional view of a conventional type of open coaxial cable.
Figure 1B:
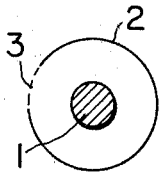

In the conventional open type coaxial cable shown in FIG. 1, no electric-wave exciting function is provided because the slot is parallel to the cable axis. Such a cable simply makes use of the protruding portion of the inner electromagnetic field of the cable. As a result, the amount of radio frequency signal coupling between the cable and a moving station travelling therealong is considerably small and unstable due to outer environmental changes surrounding the cable which affect the transmitting characteristics thereof.

The cable according to the present invention, however, provides an electromagnetic-wave exciting function over substantially the entire region of the continuous slot. Thus, it is easily possible to increase the amount of radio frequency signal coupling, and the coupling characteristics become more stable as compared with those of the prior art.

In further accordance with the principles of the invention, the period P of the slot pattern should be appropriately determined. Specifically, if the period P is established to be approximately the same or slightly longer than the wave-length of the applied signal frequency, the lines of electric force may be represented by vectors $6_1$, $6_2$, $6_3$, etc. in FIG. 3. These lines of electric force, produced by the electric current, are cut by the slot, as a result of which leakage waves are produced which radiate or propagate outwardly in a direction perpendicular to the cable. If the period P is shorter than the wave-length of the applied signal frequency, such a radiating mode is not produced, but instead only a surface-wave mode appears around the cable, as in the prior art.

Figure 4A:
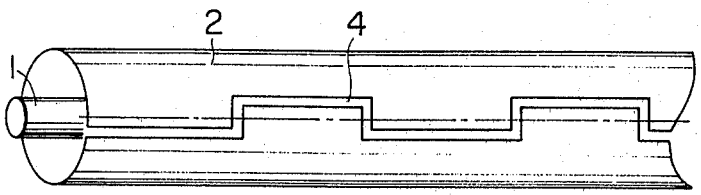
Figure 4B:
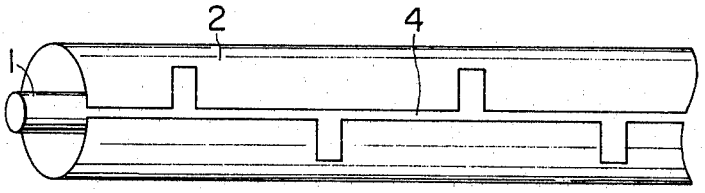
Figure 4C:
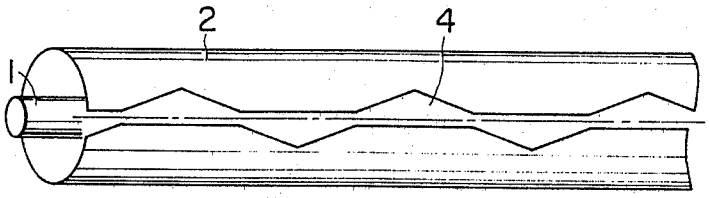

The present invention is not limited to only the above described zig-zag slot pattern, but is equally applicable to any continuous slot configuration which alternates or corrugates with a constant period with respect to the cable axis. Other embodiments according to the present invention are shown in FIGS. 4(*a*), 4(*b*) and 4(*c*), for example. In FIG. 4(*a*) the slot 4 has a rectangular configuration. In FIGS. 4(*b*) and 4(*c*) the slot 4 has a straight central portion and alternating or staggered notches in the opposite edges; the notches are rectangular in FIG. 4(*b*) and triangular in FIG. 4(*c*).

What is claimed is:

1. In a coaxial cable for radio frequency signal coupling including an inner conductor extending longitudinally with respect to the cable, an outer conductor spaced from and coaxially surrounding the inner conductor, and an electrically continuous slot in the outer conductor along the length thereof, the improvement characterized by: said continuous slot having a regular, transversely alternating configuration over less than the full circumference of the outer conductor.

2. A coaxial cable as claimed in claim 1, wherein said continuous slot has a zig-zag configuration.

3. A coaxial cable as claimed in claim 1, wherein said continuous slot has a rectangular wave configuration.

4. A coaxial cable as claimed in claim 1, wherein said continuous slot comprises a straight, central, longitudinal portion provided with regularly spaced, alternating notches in the opposite edges thereof.

5. A coaxial cable as claimed in claim 4, wherein said notches are rectangular in form.

6. A coaxial cable as claimed in claim 4, wherein said notches are triangular in form.

7. A coaxial cable as claimed in claim 1, wherein the period of said alternating slot configuration is at most as long as the wave-length of an applied signal frequency.

* * * * *